United States Patent [19]

Meister et al.

[11] 4,220,942

[45] Sep. 2, 1980

[54] CIRCUIT INTERRUPTING DEVICE

[75] Inventors: Otto Meister, Arlington Heights; Thomas J. Tobin, Northbrook, both of Ill.

[73] Assignee: S & C Electric Company, Chicago, Ill.

[21] Appl. No.: 909,144

[22] Filed: May 24, 1978

[51] Int. Cl.[3] ..... H01H 85/40

[52] U.S. Cl. ..... 337/277; 337/275; 337/279

[58] Field of Search ..... 337/277, 279, 273–275, 337/161, 162

[56] References Cited

U.S. PATENT DOCUMENTS

| | | | |
|---|---|---|---|
| 2,343,422 | 3/1944 | Rawlins | 337/275 |
| 2,429,518 | 10/1947 | Kyle et al. | 337/277 |

*Primary Examiner*—R. L. Moses

*Attorney, Agent, or Firm*—John D. Kaufmann

[57] ABSTRACT

An improved circuit interrupting device includes a pair of contacts which are relatively movable and between which an arc is established. Following melting of a fusible element, a stored energy source relatively moves the contacts apart to elongate the arc, and a container of pressurized dielectric fluid simultaneously directs fluid from a port at the arc. The fluid and the arc elongation ultimately extinguish the arc. A fusible diaphragm normally closes the port to prevent the escape of fluid, and also, due to its mechanical attachment to the contacts, restrains relative movement therebetween. The fusible element is so connected as to normally shunt current through the device away from the diaphragm. When the fusible element melts, all of the current through the device flows through and melts the diaphragm. As the diaphragm melts, two results are effected: fluid is permitted to escape from the port, and relative movement between the contacts occurs.

69 Claims, 9 Drawing Figures

CIRCUIT INTERRUPTING DEVICE

BACKGROUND OF THE INVENTION

1. Field of the Invention

The present invention relates to an improved circuit interrupting device, and, more particularly, to an improved high voltage fuse-like, circuit interrupting device which utilizes relatively movable contacts and pressurized dielectric fluid to extinguish an arc incident to circuit interruption.

2. Description of the Prior Art

Various alternating current circuit interrupting devices are well known, including fuses, circuit breakers, reclosers, circuit switchers, and the like. The present invention relates to fuses or fuse-like devices, as opposed to other types of interrupting devices.

In general, high voltage fuses utilizing a movable contact, often termed an "arcing rod", are well known. Typically, as the arcing rod moves, an arc is established between the arcing rod and a stationary contact. Such fuses normally contain a solid arc-extinguishing material (often referred to as an "ablative material") such as boric acid, 2,4-dichlorobenzoic acid or the like. Interaction of the elongating arc with the solid arc-extinguishing materials generates large quantities of high dielectric strength, arc-extinguishing gas which deionizes, cools and causes turbulence in the region occupied by the arc. These effects of the gas, in combination with the elongation of the arc as the arcing rod moves away from the stationary contact, extinguish the arc at a subsequent current zero. Typically, arcing rod movement is effected by a stored energy operator, such as a spring.

While prior art fuses of the type generally described above have been made to work well at 69 kV and below, when adapted for use at higher voltages, say 115 kV or higher, they become quite expensive and may operate inconsistently from fuse to fuse. Moreover, many prior art fuses are quite complicated and expensive, and many of the chemicals used as solid arc-extinguishing materials have recently become prohibitively priced or of uncertain availability.

Various prior art patents disclose fuses or fuse-like devices which are species of the fuses described above in general terms. This species of fuse utilizes movable contacts, stationary contacts, and various arc-extinguishing materials.

Specifically, Ackermann U.S. Pat. No. 3,265, 838 discloses a gas-propelled fuse link having a movable arcing rod. The arcing rod is hollow and, at an end remote from the arc location, mounts and communicates with a cylinder containing a pressurized, deionizing, arc-extinguishing fluid, such as $CO_2$ gas, $SF_6$ gas, or a liquid. The other end of the arcing rod is sealed by a silver of Nichrome stopper which prevents escape of the gas from the cylinder-arcing-rod combination under normal conditions. The stopper is, in turn, soldered to one end of a fusible element, the other end of which is connected to a stationary contact, the fusible element and the stopper forming an electrical series combination. When the arcing rod moves, it does so within a gas-evolving liner which includes a solid arc-extinguishing material. In operation, when the fusible element melts due to an overcurrent therethrough, a resulting arc established between the stopper and the stationary contact burns through and melts the stopper, permitting the escape of the pressurized fluid from the cylinder and the hollow arcing rod. The escape of the pressurized fluid moves the cylinder and the arching rod away from the stationary contact by a "jet action" to elongate the arc, the fluid being simultaneously directed at the arc. Arc elongation and the action of the fluid, plus the arc-extinguishing gas evolved from the liner, all ultimately extinguish the arc at a current zero.

Link U.S. Pat. No. 3,771,089 is similar to Ackermann in that a fusible element, in electrical series with a massive wall or barrier, normally confines an arc-extinguishing fluid. The fluid is released through a hole burned through the barrier by an arc established as a result of the fusible melting. The fluid is directed at the arc which is simultaneously elongated by the spring-effected movement of a pair of conductors between which the fusible element was connected. The fluid and arc elongation extinguish the arc in conjunction with gas evolved from an ablative liner made of a solid arc-extinguishing material.

Fuses or fuse-like devices similar to Ackermann and Link, wherein a massive cap or stopper is burned through by an arc established as a result of the melting of a fusible element, are also shown in Rawlins U.S. Pat. No. 2,343,422 (especially with reference to FIG. 4 thereof) and in McCloud et al. 3,032,630. In Rawlins, a fusible section is in electrical series with a massive fusible plug which normally closes a tubular member charged with a compressed dielectric gas. Melting of the fusible section by an overcurrent results in the establishment of an arc between a sleeve on a flexible conductor and the plug. The arc burns through the plug permitting the gas to flow through the arc and to blow the sleeve and the conductor away from the tubular member. In McCloud, a portable loadbreak tool includes a massive fusible tip closing a fluid-filled cartridge. The tip is burned away by an arc established between the tip and a stationary contact. The tip normally engages the contact, but moves away therefrom establishing the arc when the tool opens a cutout. The fluid flowing from the cartridge extinguishes the arc.

For purposes of the present disclosure, the Ackermann, Link, Rawlins and McCloud devices have three inexpedient characteristics. First, the fusible elements and the respective stopper, barrier, plug or tip (hereinafter called a "stopper") are in electrical series and both must carry the normal, continuous current flowing through the fuse link. As a consequence, different stoppers (i.e., different as to size, thickness and material), as well as different fusible elements, must be used at different current ratings of the devices. Accordingly, both the fusible element and the stopper determine the time-current characteristic of the fuses. Second, the stopper is burned through and melted only after the arc is established. The establishment of the arc is preceded by the melting of the fusible element. Thus, the resultant arc, and not the overcurrent per se, burns through and melts the stopper. Moreover, the devices are somewhat slow to operate due to the time it takes for the sequential occurrence of the melting of the fusible element, the establishment of the arc, and the burning through by the arc of the stopper. Third, the stopper is rather massive (to resist both the melting effect of normal current and the force exerted by the pressurized fluid) and requires substantial energy to be melted.

Two additional patents disclose devices similar to those described above, but in which a fusible stopper arguably melts as a result of an overcurrent per se, rather than as a result of an arc burning therethrough.

Frink U.S. Pat. No. 3,268,690 describes a fuse which includes a spring-biased, hollow tubular arcing rod charged with a dielectric fluid and closed by an end portion of a fusible element. Melting of the element by an overcurrent releases the arcing rod to the action of the spring for movement through a bore in a body of solid arc-extinguishing material and permits the dielectric fluid to flow from the arcing rod. Triplett U.S. Pat. No. 2,319,277 (commonly assigned herewith) in FIGS. 8 and 9 discloses a fuse similar to Ackermann in which a hollow arcing rod is spring-biased. The concurrent melting of a fusible element and of a massive fusible cap closing the arcing rod permits movement thereof and permits gas in a reservoir to flow therefrom. The arcing rod also moves through a body of solid arc-extinguishing material.

The two additional above described devices include a fusible stopper which carries normal load current through the device. Thus, the first inexpedient characteristic of Ackermann, Link, Rawlins and McCloud—the need to use different stoppers at different current ratings—is shared by these two devices. Moreover, these two devices probably share, to some degree, the second characteristic of the Ackermann, Link, Rawlins and McCloud devices: Overcurrents per se do not remove the stopper and the devices are slow to operate. Further, at least Triplett shares the third characteristic of Ackermann, Link, Rawlins and McCloud—relatively large amounts of energy are needed to partially or wholly remove the massive stopper.

Even more importantly, the repeatability and consistency (from sample-to-sample) and the predictability of operation of all the prior art devices described above are doubtful. In addition to the previously-noted deficiencies, when a fusible element is in electrical series with a stopper through which, it is expected, an arc will burn a hole, the repeatable formation (from sample-to-sample) of a sufficiently large hole cannot be assured. Specifically, if a number of similar prior art devices were to be subjected to similar normal and fault conditions, arc-burned holes having various sizes, shapes and locations would be produced due primarily to the evanescent nature of arcs and the inability to predict just where they may "root". Even Ackermann notes that "the opening [i.e., the hole] . . . may under certain conditions be too small to overcome [by 'jet action'] the forces which hold the capsule [i.e., the cartridge] . . . in place." Additionally, such variation in hole formation may be exacerbated by the variable heating effects on the stoppers caused by the variable normal currents they continuously carry. Moreover, the use of stoppers through which the arc is expected to burn a hole, to carry normal current in series with a fusible element limits the choice of ampere ratings and time-current curves severely, leading, as noted by Ackermann, to the use of different arc-burned-through stoppers at different continuous and interrupting current ratings of the devices.

A similar deficiency resides in two of the devices (Frink and Triplett) wherein, arguably, a hole is not burned through a stopper. Even there, the vagaries and uncertainties inherent in melting a massive, continuously heated stopper raises doubts that a reproducibly large hole (from sample-to-sample) will be formed to ensure sufficient fluid flow to extinguish an arc.

Rawlins U.S. Pat. No. 2,343,422 also discloses a fuse wherein melting of a high resistance fusible element ignites a body of gun powder to evolve hot gas. Current is normally shunted away from the element by a low resistance fuse wire. When the fuse wire is melted by an overcurrent, current flows through and melts the element. The evolved hot gas is passed through a material (metal shavings or boric acid) which cools and deionizes the gas or which itself evolves arc-extinguishing gas as a result of the effect of the hot gas thereon. Due to the probable presence of certain non-arc-extinguishing components (e.g., potassium or sodium) found in gun powder-evolved gas, and due to the time necessary for the sequential events to occur, the practicability of this device is suspect.

Nordhem U.S. Pat. No. 1,977,574 discloses a high tension cutout in which a pressurized gas cartridge is connected to a gas-operated interrupting unit. The cartridge is normally sealed with a sturdy disk held in place by a fusible strain wire. Normally, current flows through a typical fusible element and no current flows through the strain wire. When an overcurrent occurs, the fusible element melts and the resulting arc flashes down to a contact to momentarily flow through a current path including the fusible strain wire. Ultimately, the fusible strain wire melts and the pressure of the gas in the cartridge blows the disk therefrom. The resulting escaping gas enters the interrupting unit where it follows two paths. One path is around and along a movable arcing rod to "wipe" an arc established between the arcing rod and a stationary contact. The second path is into a piston-cylinder arrangement with the piston connected to the arcing rod. Flow of gas into the piston-cylinder moves the arcing rod away from the stationary terminal.

The Nordhem device is very complicated. Additionally, and similar to Ackermann and Rawlins, Nordhem does not provide for a stored energy source to move the arcing rod in addition to the pressure of the gas in the cartridge. Those skilled in the art will appreciate that the Nordhem cutout operates relatively quite slowly due to the time it takes for the sequential occurrence of the melting of the fusible element, the flashing down of the arc, the melting of the fusible strain wire, the blowing of the disk from the cartridge, and the movement of gas from the cartridge into the interrupting unit, where sufficient gas pressure must build up in the piston-cylinder before arcing rod movement takes place.

In most of the prior art devices where pressurized dielectric gas or fluid has been used, the gas or fluid is specifically effective only for the interruption of low fault currents. This is emphasized by the presence in the Ackermann, Frink, Link, Rawlins (semble), and Triplett patents of both contained pressurized fluid and a solid or ablative arc-extinguishing material, interaction of which with the arc produces (in addition to the fluid) arc-extinguishing gas which is primarily effective at high fault current levels. Moreover, as described above, some prior art devices (Nordhem, for example) subject the pressurized gas or fluid to long and tortuous paths before the gas or fluid can perform its arc interrupting function.

Accordingly, an overall object of the present invention is to obviate the shortcomings inherent in the above-noted prior art devices, and to provide an improved circuit interrupting device which is simple, inexpensive to manufacture, predictably reliable in operation, and which specifically does not rely on an arc burning through a stopper for its operation.

SUMMARY OF THE INVENTION

An improved circuit interrupting device in accordance with the principles of the present invention includes a pair of contacts which move relatively apart following the melting of a fusible element. A flow of dielectric fluid is directed at an arc established between the parting contacts. A fusible diaphragm normally prevents fluid flow and may also normally prevent relative movement. Facilities which includes the fusible element normally shunt away from the diaphragm current flowing through the device. After the fusible element melts, all of the current flowing through the device flows in and melts the diaphragm, following which fluid flow begins and the contacts move apart. Elongation of the arc, due to the contacts parting, and the fluid flow extinguish the arc to interrupt a circuit to which the device is connected.

In various preferred embodiments, the fluid is confined under pressure in a reservoir having a port from which the fluid flows. The diaphragm closes the port until it melts. Moreover, the reservoir mounts one of the contacts and the diaphragm is mechanically connected to the other contact, thereby preventing relative contact movement until the diaphragm melts. The fusible element is preferably connected at one end to the other contact, and a stored energy source biases the contacts apart. Typically, the device includes opposed circuit-connectable terminals, the reservoir and the diaphragm being electrically conductive. The reservoir is electrically connected between the one contact and one of the terminals, while the other contact is electrically connected to the other terminal. The other end of the fusible element is connected to the one terminal. As a result, much of the current flowing through the device between the terminals follows a first shunt path which includes the other contact and the fusible element, while some of the current may follow a second path which includes the other contact, the diaphragm and the reservoir. The other end of the fusible element may be electrically connected to the one terminal by a connection to the reservoir remote from the diaphragm.

The relative amounts of current flowing through the first and second paths are such that the fusible element, not the diaphragm, predominates in determining the time-current characteristic of the device. Preferably, the first path carries the majority of the current through the device, while the diaphragm carries a minority of such current.

Although either or both contacts may be movable, it is preferred that the one contact is stationary, and the other contact is movable.

As used herein, the word "melting" as applied to either the fusible element or the diaphragm means melting, fusing, vaporizing or any thermally-effected cessation of intactness other than arc-effected burning through. Moreover, the word "gap" means the separation or distance between the relatively movable contacts as they move apart and after such movement is completed. Prior to arc extinguishment, the arc is established in the gap; after arc extinguishment and the completion of relative contact movement, no arc is in the gap and no conduction between the contacts occurs.

DETAILED DESCRIPTION

Figure 1:
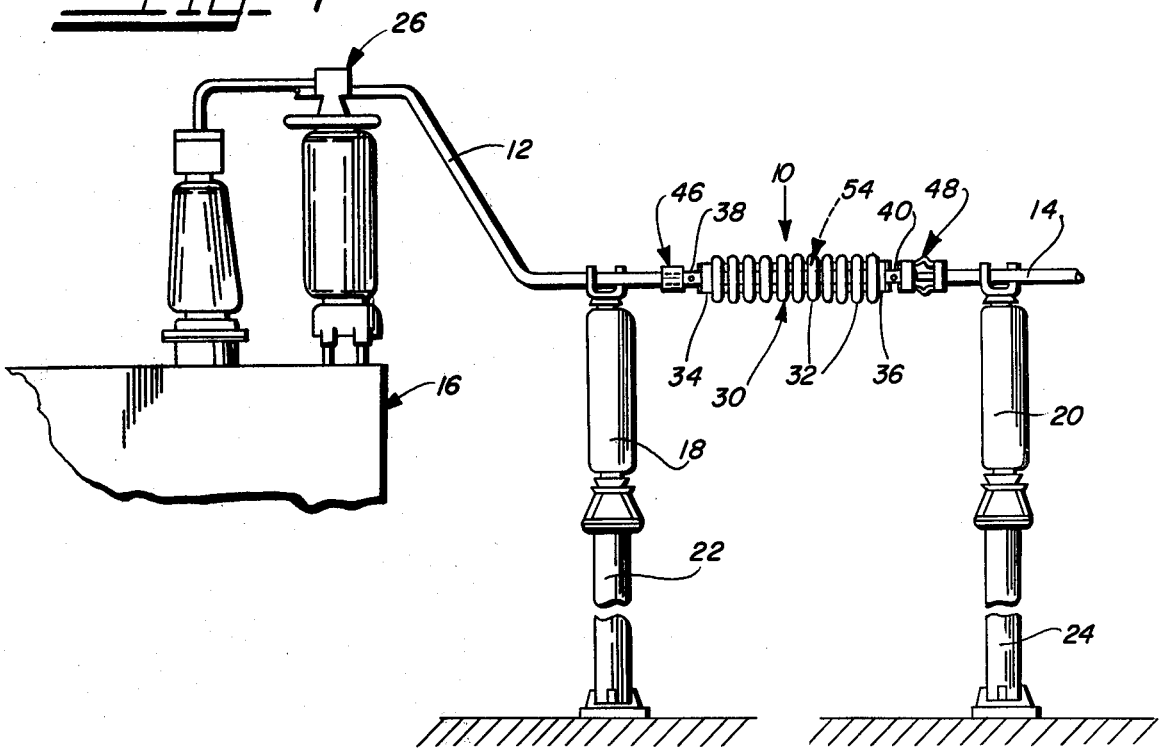
FIGS. 1–3 are general views of a circuit interrupting device according to the present invention, the device being used in various configurations for the protection of a transformer.
Figure 2:
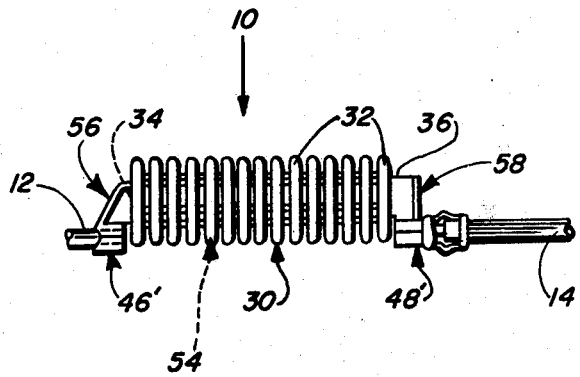
Figure 3:
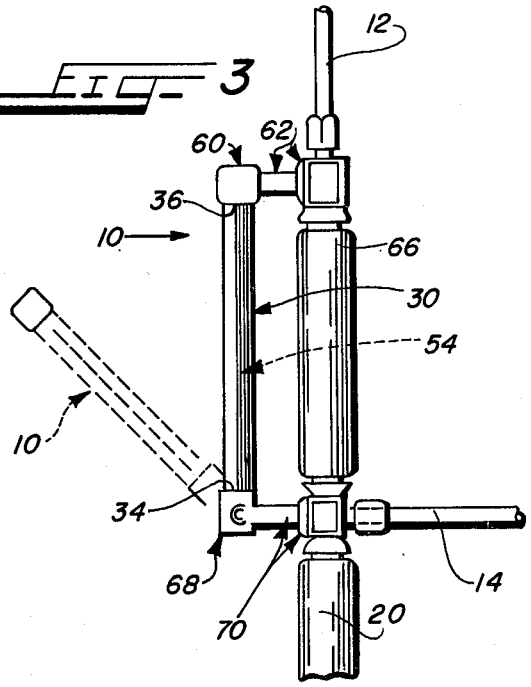

General; FIGS. 1–3

A circuit interrupting device 10 according to the present invention is shown in FIG. 1 coaxially mounted directly to, and supported by, buses 12 and 14 which supply alternating electric current through the device 10 to a transformer 16. The buses 12 and 14 may be respectively supported at or near either end of the device 10 by insulator stacks 18 and 20 which may, in turn, be mounted to respective vertical support columns 22 and 24. The bus 12 is connected to a bushing 26 of the transformer 16. The bus 14 is connected to an upstream high voltage source (not shown), and a breaker or similar protective device (not shown) may be located in the bus 14 intermediate the voltage source and the device 10.

The device 10 includes an outer, insulative, dielectric housing 30 which may contain leakage-distance-increasing skirts 32 to prevent flashover or discharge across the housing 30 after the device 10 has interrupted and opened the circuit 12,14. The opposed ends of the housing 30 mount opposed conductive end ferrules or terminals 34 and 36, depending from which may be respective mounting ears 38 and 40 (FIGS. 4*a*, 5 and 5*a*). The ears 38 and 40 may have respective slots 42 and 44 to receive bolts, pins or the like held by appropriate device amounts 46 and 48 respectively attached to, or forming a part of, the buses 12 and 14.

The interrupting device 10 includes an interrupting unit 54 having various component parts which form the primary subject matter of the present invention. The structure and operation of the interrupting unit 54, and of its component parts, are described below in greater detail.

FIG. 2 depicts an arrangement similar to FIG. 1 in which a slightly exteriorly modified interrupting device 10 has been mounted to the buses 12 and 14. To the extent that the device 10 of FIG. 2 is the same as that of FIG. 1, the same reference numerals are used for similar elements. In FIG. 2, the ears 38 and 40 are replaced by mounting assemblies 56 and 58 which cooperate with modified mounts 46' and 48' on the respective buses 12 and 14 to mount the device 10 slightly above a line defined by the buses 12 and 14.

FIG. 3 shows yet another mounting variation for the device 10 of the present invention. Similar elements bear the same reference numerals used in FIGS. 1 and 2. In FIG. 3, the device 10 is vertically mounted to the buses 12 and 14 so as to permit a dropout function incident to operation of the interrupting unit 54. In FIG. 3, the device 10 is normally vertically oriented and includes on one end ferrule 36 jaw engaging facilities 60 which cooperate with a jaw contact 62 attached to the bus 12. The jaw engaging facilities 60 and the jaw contact 62 cooperate to normally maintain the device 10 in the vertical position of FIG. 3. The jaw contact 62 is supported on a vertical insulator 66. The other end ferrule 34 mounts an appropriate hinge facility 68 which cooperates with a hinge contact 70 connected to the bus 14 to permit rotation or pivoting of the device 10 about the hinge contact 70 on the hinge facility 68. The hinge contact 70 is mounted intermediate the vertical insulator 66, which maintains the jaw contact 62 and the hinge contact 70 in insulated, spaced relation, and the support insulator stack 20. The normal position of the device 10 is shown in solid lines in FIG. 3; its rotated or dropout position is shown in dotted lines. The dropout position of the device 10 is achieved following an operation of the interrupting unit 54 which interrupts the circuit 12,14 as described below. Note that the arrangement of FIG. 3 eliminates the insulator stack 18 and the column 22 of FIG. 1, the device 10 being supported by the insulator stack 20 and the insulator 66, while vertical stability is supplied by connection of the bus 12 to the bushing 26.

Any other mounting structure or configuration, dropout or non-dropout, for the device 10 may be chosen. The various parts of the above-described mounting structures in FIGS. 1–3 may be modified or changed, as they form no necessary part of the present invention.

Some additional general differences, other than the mounting structure, may exist among the arrangements shown in FIGS. 1–3. According to certain embodiments of the present invention, the interrupting device 10 shown in FIG. 1 is intended to be wholly replaced following circuit-protective operation thereof. The device 10 shown in FIG. 2 performs a similar circuit-protective function, but is adapted to have only the interrupting unit 54 replaced in the housing 30 following operation of the device 10. Accordingly, the device 10 of FIG. 2 is not coaxial with the buses 12 and 14 to facilitate such replacement of the interrupting unit 54 without having to remove the entire device 10 from the buses 12 and 14. Such replacement may be effected by removal of one of the ferrules 34 or 36 and its associated mounting assembly 56 or 58, following which the interrupting unit 54 is removed and a new interrupting unit 54 is inserted. Only the end of the device 10 from which the ferrule 34 or 36 is removed need be supported during replacement of the interrupting unit 54; the other ferrule 36 or 34 may remain supported by its associated mount 48' or 46'.

Because of the dropout function of the device 10 of FIG. 3, and the consequent large air gap between the jaw engaging facilities 60 and the jaw contact 62, there may be no need for the housing 30 to contain the skirts 32. The device 10 of FIGS. 1 and 2 may require the skirts 32 because these devices 10 remain connected between the buses 12 and 14 after circuit interruption and must be able to continuously withstand the high voltages imposed by the circuit 12,14 across the device 10.

If desired, the devices 10 of FIGS. 1 and 2 may include an operation indicator, generally designated 72 and more completely described below. In FIGS. 1 and 2, the operation indicator 72 is generally shown as within the end ferrule 36, although either ferrule 34 or 36 may be used. The device 10 of FIG. 3 requires no indication operator 72 inasmuch as its location in the dropout position (dotted lines) provides sufficient visual indication that the device 10 has operated.

Figure 4:
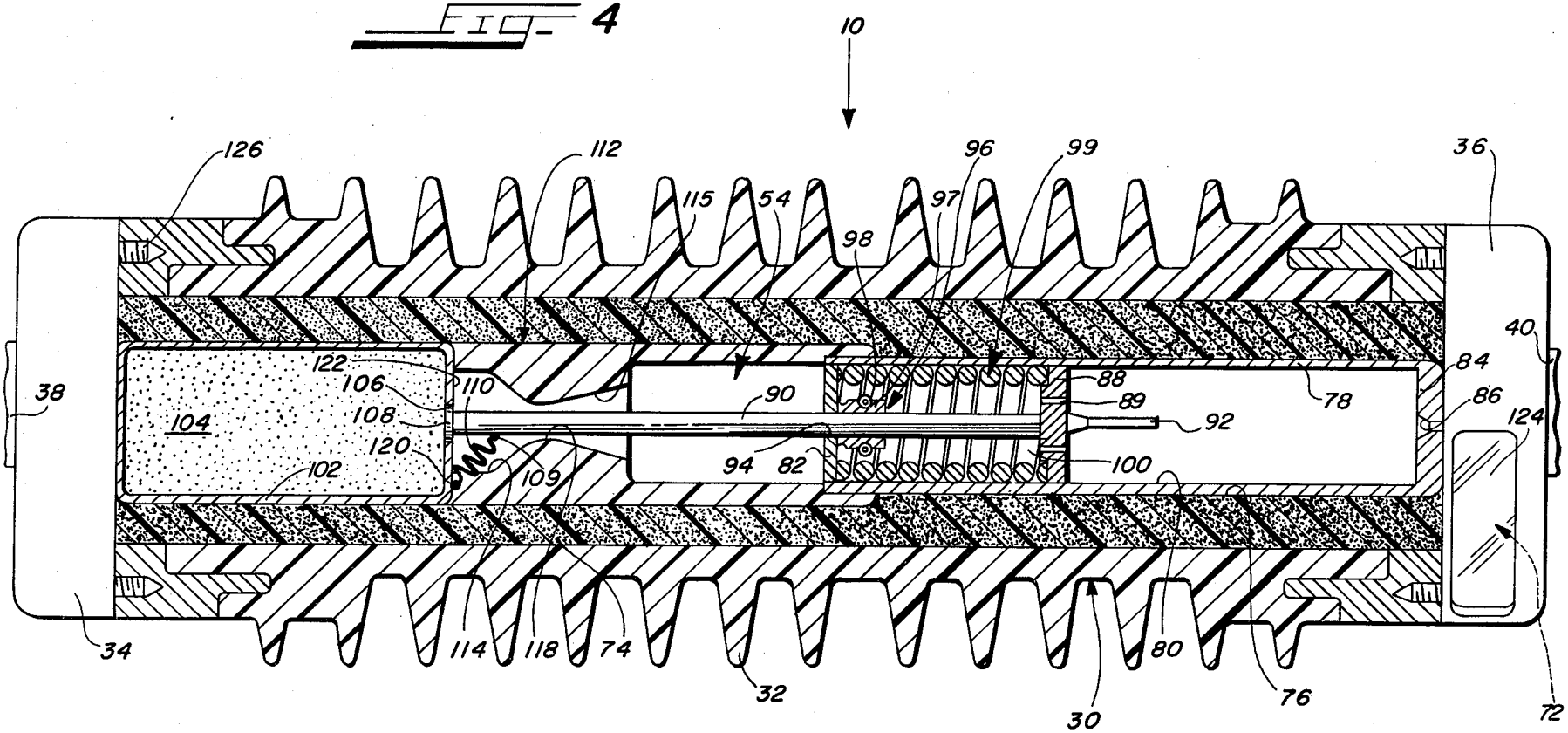
FIG. 4 depicts the normal condition of a first embodiment of the device of FIGS. 1–3 wherein the device has a single interrupting gap.
Figure 4A:
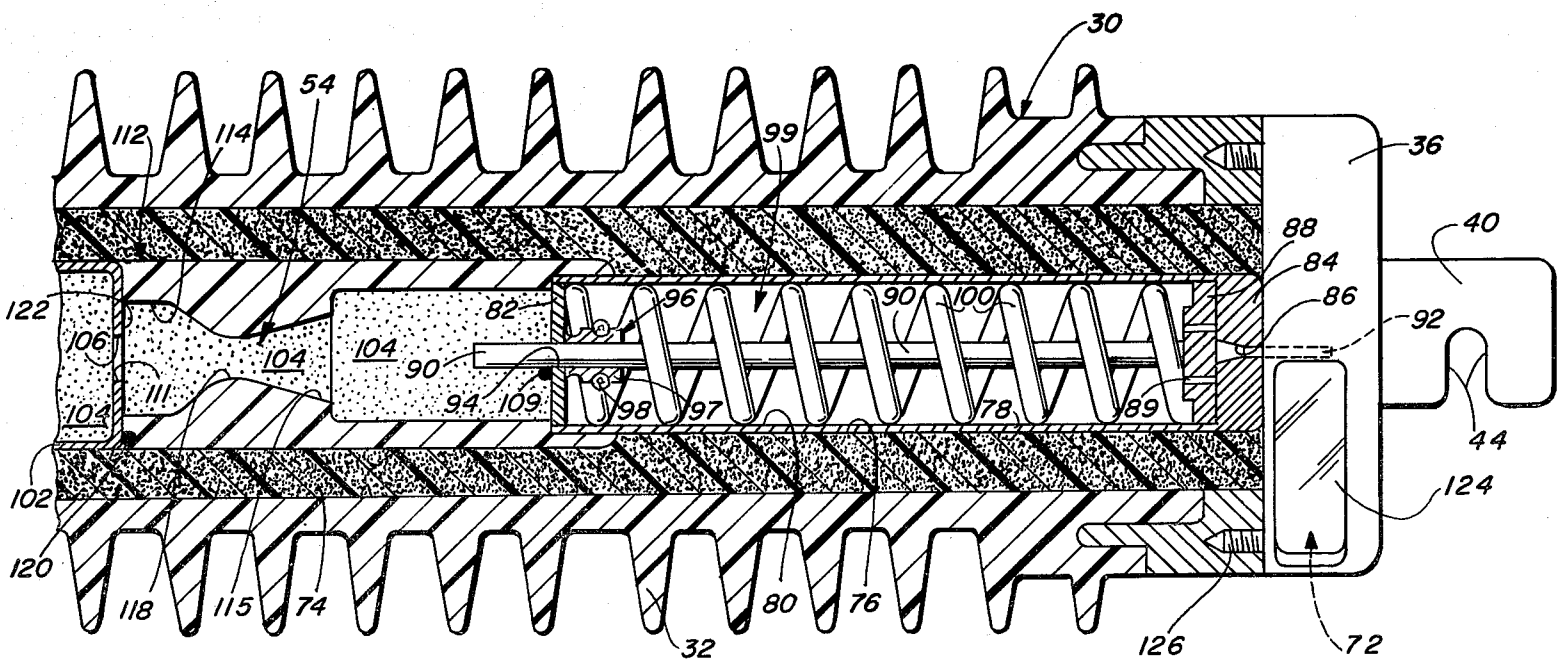
FIG. 4*a* depicts the device of FIG. 4 after operation thereof.
Figure 5:
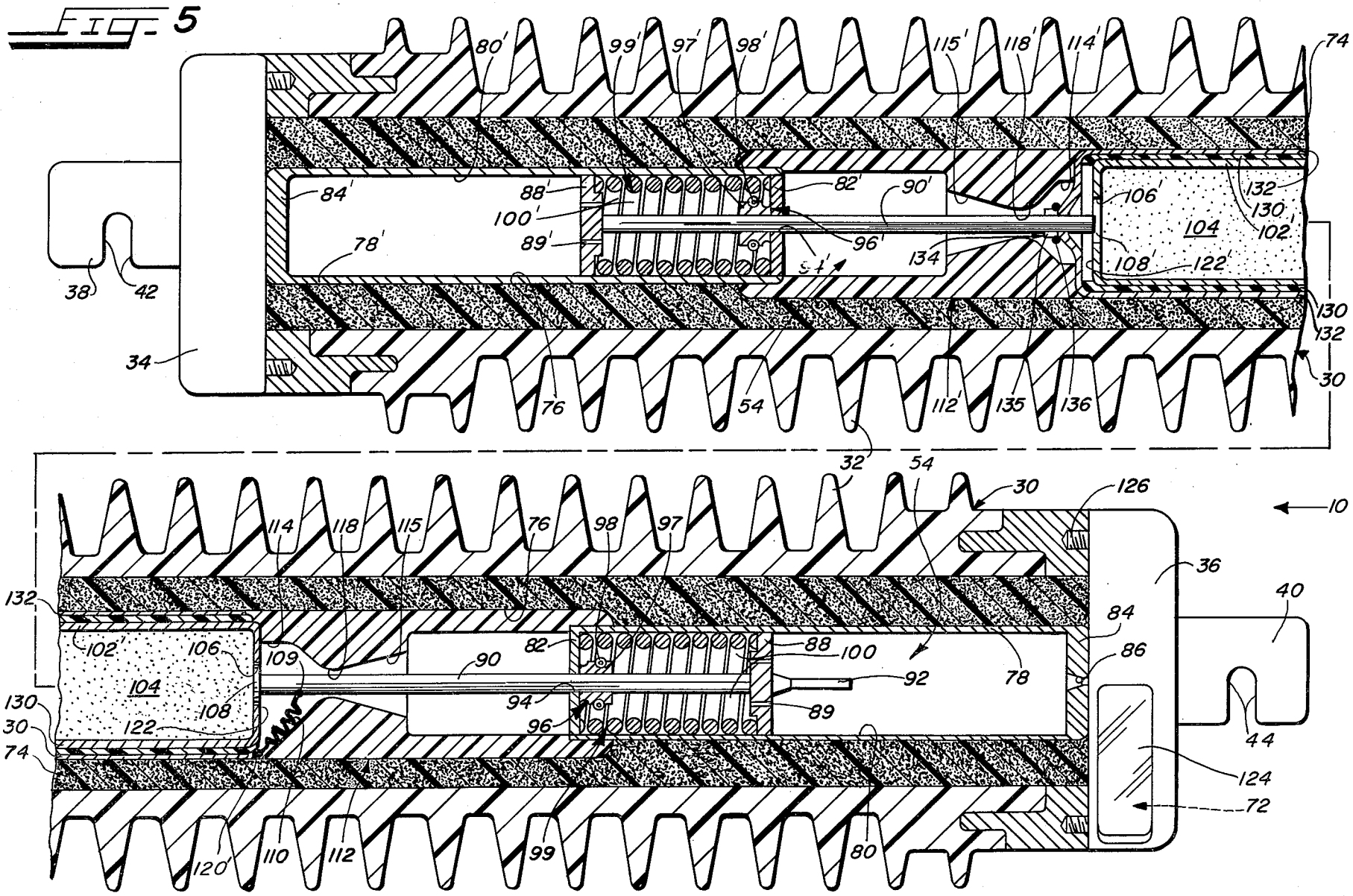
FIG. 5 depicts the normal condition of a second embodiment of the device of FIGS. 1–3 wherein the device has two interrupting gaps.
Figure 5A:
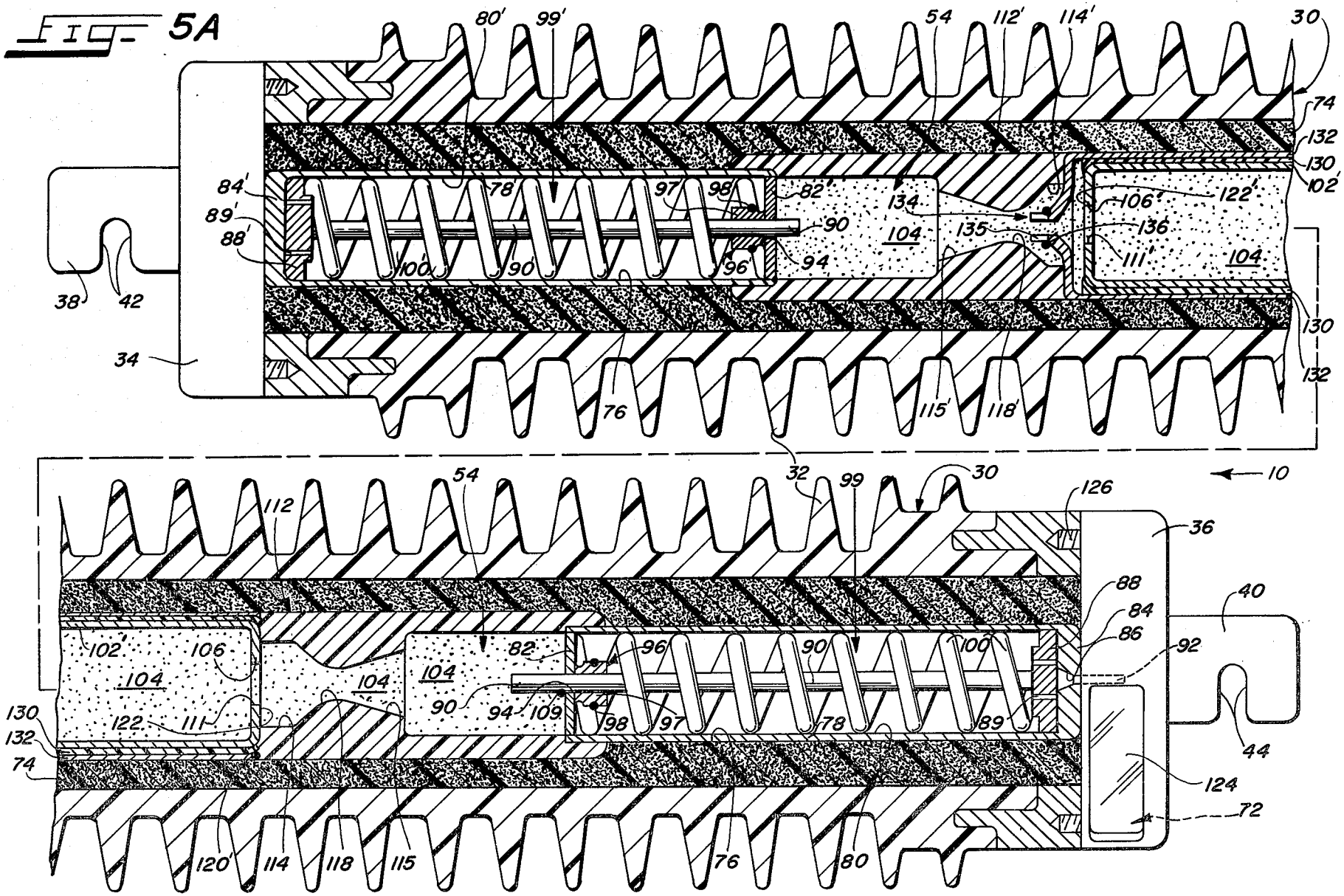
FIG. 5*a* depicts the device of FIG. 5 after operation thereof.

Interrupting Unit 54—FIGS. 4 and 4*a*—First Embodiment

The interrupting device 10 of FIGS. 1–3 may, in accordance with the principles of the present invention, have either a single-gap or a double-gap interrupting unit 54. Illustrated in FIGS. 4 and **4*a* is one version of a single-gap interrupting device 54**.

Coaxially mounted within the housing 30 may be an insulative cylinder 74, preferably made of a low dielectric permitivity, high dielectric strength material, which may be a foamed-in-place rigid dielectric foam which contains and fixes in place various elements of the interrupting unit 54. The cylinder 74 may also be selectively removable from the housing 30 as will appear hereinafter. The housing 30 and the cylinder 74 may be separate members or unitary, and may be made of the same or different insulative materials.

The cylinder 74 contains and maintains in a fixed position a coaxial conductive tube 78 defining an internal chamber 80. The chamber 80 is closed at both ends by respective, conductive end walls 82 and 84 which may be attached to, or formed integrally with, the tube 78. The end wall 84 abuts, or is otherwise in electrical contact with, the interior of the end ferrule 36 so that a continuous electrical path is formed via the tube 78 between the end ferrule 36 and the wall 82. The wall 82 may be spoke-like or vented for a purpose to be hereinafter described.

Mounted for axial sliding movement within the chamber 80 of the conductive tube 78 is a conformal plate 88, which may have one or more passages 89 therethrough. The plate 88, which may be conductive, is freely slidable in the tube 78 along the axis thereof. The plate 88 is fixed to one end of a conductive, movable metal contact or arcing rod 90. At the end of the arcing rod 90 mounted to the plate 88 is an elongated pin-like member 92 having an outer configuration which is generally complimentary to an aperture 86 formed in the wall 84. The function of this pin-like member 92 will be described later.

The arcing rod 90 enters the chamber 80 through an aperture 94 formed in the wall 82. Surrounding this aperture 94 within the chamber 80, and in sliding contact with the surface of the arcing rod 90, may be a tulip contact arrangement 96 attached to or integral with the wall 82. The tulip contact 96 ensures electrical continuity between the movable arcing rod 90 and the ferrule 36, via the conductive tube 78, in all positions of the arcing rod 90. To ensure good electrical contact, fingers 97 of the tulip contact 96 may be continuously biased against the arcing rod 90 by a garter spring 98. If desired, the tulip contact 96 may be eliminated. In this event, electrical continuity between the arcing rod 90 and the ferrule 36 may be provided by the sliding engagement between the plate 88 and the tube 78, and between the arcing rod 90 and the wall of the aperture 94. The interfaces 88/78 and 90/94 may contain any well-known sliding contact facility (not shown).

Movement of the arcing rod 90 along its axis and the axis of the housing 30, the insulative tube 74 and the chamber 80 is effected by a stored energy source 99. A preferred stored energy source 99 is a coaxial, normally-compressed operating spring 100, although a tension spring may be used. The spring 100 is contained within the chamber 80 and acts against the movable plate 88 and the wall 82. The energy stored in the compressed spring 100 is effective to rapidly move the plate 88 toward the wall 84 to pull the arcing rod 90 in that same direction. The passages 89 in the plate 88 prevent a pressure build-up in the chamber 80 which might inhibit rapid movement of the arcing rod 90.

Also contained within, and maintained in a fixed position by, the insulative tube 74 at a location remote from the conductive tube 78 is a reservoir 102, which may be any convenient container or vessel, such as a canister, cartridge or the like. Stored at greater than atmospheric pressure within the reservoir 102 is a quantity of dielectric fluid 104, such as liquid or gaseous $SF_6$, or other liquid or gaseous arc-extinguishing medium. The reservoir 102 has formed therein a port 106 through which the fluid 104 may issue. Preferably, the reservoir 102 is made of a conductive metal.

The port 106 is normally closed to prevent the escape of the fluid 104 by a metal diaphragm 108, more completely described below. The diaphragm 108 may be attached to the port 106 by soldering, brazing or the like. The end of the arcing rod 90 remote from the pin-like member 92 is preferably normally joined or mechanically attached to, and held against movement by, the diaphragm 108. In this condition, the spring 100 is unable to move the arcing rod 90.

Electrically connected to the arcing rod 90 at a point 109 thereof spaced away from its point of attachment to the diaphragm 108 is one end of a fusible element 110. The fusible element 110 may be formed of silver, or of an alloy thereof, and the point 109 may comprise a solder joint or the like. The fusible element 110 is so designed and composed as to have a predetermined time-current characteristic (TCC), that is, a well-defined melting or fusing point when its temperature reaches a predetermined level due to the flow therethrough of sufficient current for a predetermined time. The manufacture and design of various fusible elements 110 for use in various circuits 12,14 having various continuous and fault current levels are well known.

The diaphragm 108 is made of a conductive material which melts entirely or partially when a current of a predetermined level flows therethrough for a predetermined time. Moreover, the diaphragm 108 is preferably sufficiently, mechanically robust to physically hold and restrain movement of the arcing rod 90 under the influence of the compressed spring 100, as well as to resist the force of the pressurized fluid 104. The diaphragm 108 may, therefore, be a thin disk of stainless steel, although other metals may be used.

In order to ensure the melting of the diaphragm 108, its cross-sectional thickness may be varied. For example, a pattern of decreased thickness may be formed therein, as by stamping, scoring or the like, so that melting along the pattern is ensured when sufficient current flows therethrough for a sufficient time. Any pattern so formed must not prevent the diaphragm 108 from restraining the arcing rod 90 and resisting the force of the fluid 104. Whether the diaghragm 108 melts in toto or along the pattern is unimportant as long as a sufficiently large hole 111 (FIG. 4*a*) is produced thereby, as more fully described below.

According to the present preferred embodiment, in the normal condition of the device 10 and of the interrupting unit 54, the electrical resistance of a first or shunt current path—which includes the arcing rod 90 and the fusible element 110—is much lower than the electrical resistance of a second current path—which includes the arcing rod 90 and the diaphragm 108. This is easily achieved where the material (e.g., stainless steel) of the diaphragm 108 has a higher bulk resistivity than the material (e.g., silver) of the fusible element 110. Moreover, any pattern formed in the diaphragm 108 raises its electrical resistance to aid in achieving the higher resistance of the second current path. As should be obvious, other schemes—such as a high resistance joint between the arcing rod 90 and the diaphragm 108, or high resistance separately included in the second current path—may be used to ensure the required resistance relationship of the first and second current paths.

An important aspect of the present invention is that the fusible element 110, not the diaphragm 108, determines the time-current characteristic of the device 10. This is achieved in the preferred embodiment by adjusting the relative resistances of the first and second paths so that most—if not all—of the current normally flowing through the device 10 flows in the fusible element 110 and not in the diaphragm 108. In this manner, when the fusible element 110 melts, the diaphragm 108 experiences a sufficiently large increase of current therein to ensure that it melts. Those skilled in the art will, of course, appreciate that various ratios between the current flowing in the first and second paths will achieve these same ends, namely that the time-current characteristic (TCC) of the device 10 depends exclusively, or nearly so, on the TCC of the fusible element 110, and that melting of the diaphragm 108 necessarily follows the melting of the fusible element 110. Thus, a ratio of 1:1 between the currents in the two paths may be permissible. Clearly, a ratio of, say, 9:1—the current in the second path being the larger—is not desirable, for the TCC of the diaphragm 108 may now be more determinative of the device's TCC than is that of the fusible element 110, and, when the fusible element 110 melts, the increase of the current in the diaphragm 108 may not be sufficient to melt it. Just as clearly, if no current normally flows in the diaphragm 108 until the fusible element 110 melts, the ends of the present invention may be achieved, as long as the amount of current required to melt the diaphragm 108 is equal to or less than the amount of current required to melt the fusible element 110. Those skilled in the art will appreciate that the exact ratio of the current normally flowing in the two paths can be adjusted between these extremes according to numerous factors, such as the material of the diaphragm 108 and the desired TCC of the device 10.

Within the insulative tube 74 and located between the port 106 and the wall 82 may be a nozzle 112. The function of the nozzle 112 is to direct fluid 104 flowing from the port 106 at an arc which is established in the gap between the arcing rod 90 and a stationary contact, as more fully described below. The nozzle 112 may be made of an insulative material which can withstand high temperatures, for example, PTFE (polytetrafluoroethylene), sold under the trade name Teflon. The nozzle 112 defines two chambers 114 and 115. Fluid 104 flowing from the port 106 into the first chamber 114 reaches sonic velocity at a constriction or narrowed throat section 118 which joins the chambers 114 and 115. Gas flows through the first chamber 114 and past the throat 118 into the second chamber 115 during a circuit interruption operation of the interrupting device 10. It may be desirable for the throat 118 to be conformal to and slidingly engage the arcing rod 90 so that no substantial amount of fluid 104 can flow into the chamber 115 until the arcing rod 90 has achieved high velocity.

This embodiment of the present invention contemplates that a majority of the current flowing through the device 10 between the ferrules 34 and 36 normally flows in the first or shunt current 90, 110, while a minority of the current flows in the second current path 90, 108. To this end, the reservoir 102 contacts, or is otherwise electrically connected to the end ferrule 34, thus connecting the second current path 90, 108 between the ferrules 34 and 36 as follows: the ferrule 34, the reservoir 102, the diaphragm 108, the arcing rod 90, the tulip contact 96, the wall 82, the conductive tube 78, the wall 84, and the ferrule 36. To ensure that the first or shunt current path 90, 110 carries most of the current, it is connected between the ferrules 34 and 36 in such a way as to shunt current around, or away from, the diaphragm 108. To this end, a conductor (not shown) insulated from the reservoir 102 may connect the other end of the fusible element 110 to the ferrule 34. Preferably, however, in this embodiment the other end of the fusible element 110 is simply connected to the reservoir 102 at a point 120 remote from the diaphragm 108, thus connecting the first current path 90, 110 between the ferrules 34 and 36 as follows: the ferrule 34, the reservoir 102, the point 120, the fusible element 110, the point 109, the arcing rod 90, the tulip contact 96, the wall 82, the conductive tube 78, the wall 84, and the ferrule 36. Most of the current flowing through the arcing rod 90 normally flows through the fusible element 110 and not through the diaphragm 108 because of the much lower electrical resistance possessed by the first or shunt current path 90, 110. More specifically, because the electrical resistance of the second current path 90, 108 is substantially higher than that of the first current path 90, 110, the fusible element 110 is effective to shunt substantially all of the current away from the diaphragm 108.

In using the device 10, as long as the current flowing in the circuit 12, 14 to which the end ferrules 34 and 36 are mounted is normal and not excessive, the fusible element 110 remains intact, as does the diaphragm 108. As a consequence, the diaphragm 108 mechanically prevents movement of the arcing rod 90 by the spring 100 and prevents the fluid 104 from flowing from the port 106.

Should a current of sufficient magnitude and duration flow in the circuit 12, 14, the fusible element 110 melts. At the instant the fusible element 110 melts and ceases to be intact, the current, which is normally shunted away from the diaphragm 108, is suddenly diverted from the arcing rod 90 through the diaphragm 108. The increased current through the diaphragm 108 causes the diaphragm 108 to wholly or partially melt producing the hole 111, which in FIG. 4*a* is shown to be congruent with the port 106 due to the assumed melting of the entire diaphragm 108.

When the diaphragm 108 melts and is no longer intact, two consequent actions follow which are depicted in FIG. 4*a*. First, the spring 100 moves the arcing rod 90 away from the reservoir 102. The initial melting of the diaphragm 108 and the initial movement of the arcing rod 90 results in the establishment of a high voltage arc between the end of the arcing rod 90 formerly attached to the diaphragm 108 and one or more portions 122 of the reservoir 102 immediately surrounding the port 106. The portion(s) 122 thus serves as a stationary contact and will be referred to as such hereafter. Obviously, a separate stationary contact structure (not shown) could be provided at or near the port 106. Movement of the arcing rod 90 away from the reservoir 102 and from the stationary contact 122 elongates the arc. Second, the partial or total absence of the diaphragm 108 permits the pressurized dielectric fluid 104 to flow from the reservoir 102, through the hole 111 and the port 106, and then through the nozzle 112, its velocity reaching sonic or near sonic velocity at or near the throat 118. If the throat 118 is conformal to the arcing rod 90, such fluid flow is retarded until the arcing rod 90 is rapidly moving and a substantial gap exists between the arcing rod 90 and the stationary contact 122. The rapidly flowing fluid 104 is directed at the elongating arc as the arcing rod 90 continues to move. The cooling, turbulent, and deionizing characteristics of the fluid 104, in conjunction with elongation of the arc, extinguish the arc at a subsequent current zero.

The spring 100 continues to move the arcing rod 90 until the pin-like member 92 enters and passes through the aperture 86. The length of the pin-like member 92 is greater than the thickness of the wall 84, so that a portion of the pin-like member 92 ultimately protrudes therebeyond. A transparent window 124 in the end ferrule 36 (which may be partially hollow) forms a part of the operation indicator 72 and permits an operator to view either the pin-like member 92 protruding beyond the wall 84 or a target mechanism (not shown) which is moved to a visible position by the member 92, as is well known. To this end, the pin-like member 92 or the target mechanism may be vividly colored, such as with red or orange paint, to facilitate the operator's viewing the presence of either through the window 124.

As discussed earlier, the interrupting devices 10 of FIGS. 1 and 2 differ in that the device 10 of FIG. 1 is wholly replaced after operation, while the device 10 of FIG. 2 has only the interrupter unit 54 replaced. To this end, in the device 10 of FIG. 1, the insulative tube 74 may be attached to, or integral with, the housing 30 such as by molding the housing 30 around the insulative tube 74. If the device 10 is of the type depicted in FIG. 2, the insulative tube may be slideably insertable in, and removable from, the housing 30 upon removal of one of the end ferrules 34 or 36 through any convenient technique. For example, one of the end ferrules 34 or 36 may be threaded onto, or held by screws 126 on, one end of the housing 30 so that its removal facilitates the removal of the insulative tube 74 for replacement thereof following operation of the device 10. In this event, the tube 74 carries and mounts the reservoir 102, the fusible element 110, the nozzle 112, the stored energy source 99, and the conductive tube 78, all as a replaceable, modular interrupting unit 54 for the device 10.

Interrupting Unit 54—FIGS. 5 and 5*a*—Second Embodiment

The device 10 of FIGS. 4 and 4*a* is a so-called single-gap device. Should the voltage-current characteristics of a particular circuit 12, 14 require, or make advisable, the use of a two-gap device, an alternative embodiment such as depicted in FIGS. 5 and 5*a* may be used. Essentially, the two-gap device 10 of FIGS. 5 and 5*a* comprises two of the devices 10 of FIGS. 4 and 4*a* positioned seriatim. Accordingly, elements which are the same as, or similar to, those shown in FIGS. 4 and 4*a* have been given the same or similar reference numerals in FIGS. 5 and 5*a*. New reference numerals are used in FIGS. 5 and 5*a* for those elements which are substantially different from the elements of FIGS. 4 and 4*a*, or which are not present therein.

The right-hand side of FIG. 5 is similar to FIG. 4, one difference being that a reservoir 102' somewhat larger than the reservoir 102 is provided. Surrounding the reservoir 102' are members 130 and 132. The first member 130 is an insulative sleeve or cylinder which surrounds the outer periphery of the reservoir 102' to electrically insulate it from the second member 132, which is an electrically conductive sleeve or cylinder members 130 and 132 may take any other convenient configuration, such as flat or arcuate, or may together be replaced by a conductor (not shown) insulated from the reservoir 102' in any convenient manner. A second difference from FIG. 4 is that in FIG. 5 the fusible element 110 is connected between the arcing rod 90 (at the point 109) and an end of the conductive cylinder 132 (at a point 120').

The left-hand portion of FIGS. 5 and 5*a* contains many elements which are the same as or similar to the right-hand portion thereof and the same or similar reference numerals have been used therefor.

A left-hand arcing rod 90' is mechanically and electrically connected to a left-hand diaphragm 108' as described above. Surrounding the end of the arcing rod 90' near its connection to the diaphragm 108' and in sliding electrical contact therewith is a sliding contact structure, such as a tulip contact 134, having a plurality of fingers 135 which may be maintained in sliding engagement with the arcing rod 90' by a garter spring 136. The tulip contact 134 may be formed as a part of, or be otherwise connected to, the member 132. The tulip contact 134 is located near, but is spaced from, a left-hand port 106' of the reservoir 102'. The purpose of the members 130 and 132 and of the tulip contact 134 is to ensure the shunting of current away from both diaphragms 108 and 108' under normal conditions. In the single-gap structure of FIGS. 4 and 4*a*, this shunting could be easily achieved by merely connecting the fusible element 110 between the arcing rod 90 and the reservoir 102. However, where the second diaphragm 108' is present, some variant technique must be employed to ensure that current is also shunted away from the diaphragm 108'. The technique depicted herein is exemplary only; those skilled in the art will be able to devise various other ways of effecting this dual shunting function.

The left-hand side of the device 10 also includes a conductive tube 78' similar to the tube 78 and having a wall 84' thereof in electrical contact with, or otherwise electrically connected to, the ferrule 34. Included with, or cooperating with, the tube 78' are a plate 88', a spring 100', a wall 82', and a tulip contact 96', all constructed and functioning similar to their counterparts in FIGS. 4 and 4*a*, and the right side of FIG. 5.

A first or shunt current path 90, 110, 132, 136, 90' is connected between the ferrules 34 and 36 as follows: the end ferrule 34, the wall 84', the conductive tube 78', the wall 82', the tulip contact 96', the arcing rod 90', the tulip contact 136, the member 132, the point 120', the fusible element 110, the point 109, the arcing rod 90, the tulip contact 96, the wall 82, the conductive tube 78, the wall 84, and the ferrule 36. A second current path, constituting the arcing rods 90 and 90', the diaphragms 108 and 108', and the reservoir 102', is connected between the ferrules 34 and 36 as follows: the end ferrule 34, the wall 84', the conductive tube 78', the wall 82', the tulip contact 96', the arcing rod 90', the diaphragm 108', the reservoir 102', the diaphargm 108, the arcing rod 90, the tulip contact 96, the wall 82, the conductive tube 78, the wall 84, and the ferrule 36. Due to previously-discussed factors—such as the relative resistivites of the diaphragms 108 and 108' and the fusible element 110; the resistive nature of the point of attachment between the arcing rods 90 and 90', and their diaphragms 108 and 108'—the first current path 90, 110, 132, 136, 90' shunts away from the second current path 90, 108, 102', 108', 90' most of the current flowing through the device 10 between the ferrules 34 and 36. It should be noted that the point 109, the isolation of the member 132 from the reservoir 102', and the point of engagement of the arcing rod 90' by the tulip contact 136 are all selected so as to ensure this shunting function.

Should the fusible element 110 melt, for example due to an overcurrent, the device 10 of FIG. 5 performs a circuit interrupting function similar to that described with reference to FIGS. 4 and 4*a*, except that a pair of gaps each having an arc therein are opened.

Specifically and referring to FIG. 5*a*, upon the melting of the fusible element 110, the current normally flowing in the first or shunt current path 90, 110, 132, 136, 90' is suddenly diverted through the second current path 90, 108, 102', 108', 90'. Such current flow substantially simultaneously melts both diaphragms 108 and 108' to release both arcing rods 90 and 90' for oppositely-directed movement under the action of the springs 100 and 100', and permits the compressed fluid 104 to flow from the reservoir 102' through both holes 111 and 111'; both ports 106 and 106'; and both nozzles 112 and 112'. Ultimately, as described with reference to FIG. 4*a*, both arcs established between the arcing rods 90 and 90' and their corresponding stationary contacts 122 and 122' are extinguished.

Even though both arcing rods 90 and 90' move during the operation of the device 10 in FIG. 5, an operation indicator 72, where used, need be included at only one end of the device 10, as shown. In this event, one of the arcing rods, such as the left-hand arcing rod 90', need not carry at its end adjacent the plate 88' the pin-like member 92. Consequently, the wall 84' of the left-hand conductive tube 78' need not contain the aperture 86.

Figure 6:
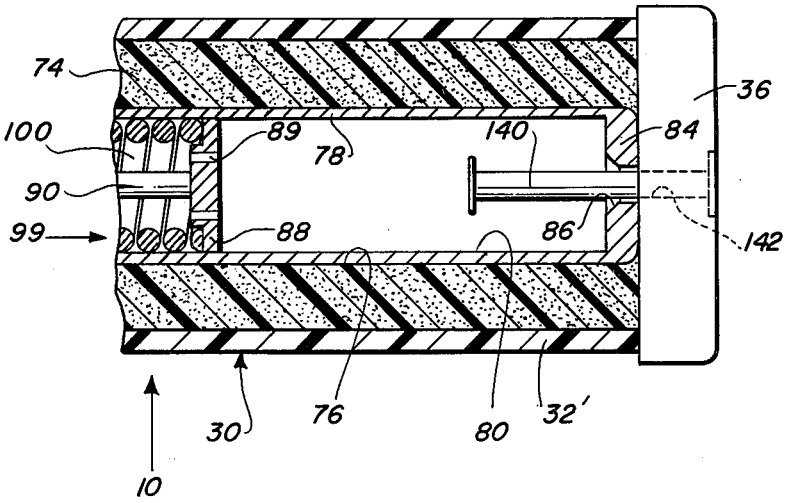
FIG. 6 depicts a portion of the device of FIG. 4 capable of performing a dropout function.

Alternative Embodiment—FIG. 6

Only the right-hand side of a device 10 such as depicted in FIGS. 4, 4*a*, 5 and 5*a* is shown in FIG. 6. As in FIGS. 4 and 5, the device of FIG. 6 may be a single-gap or a two-gap device 10. The device 10 of FIG. 6 is intended to be of the type depicted in FIG. 3 which performs a dropout function. Many of the parts shown are similar to, or are the same as, those shown in earlier Figures and the same or similar reference numerals have been used. As noted earlier, the housing 30 of the device 10 intended for dropout function may not require the skirts 32. Where the skirts 32 are not necessary, the housing 30 includes a tough weather-resistant structure or skin 32' of an appropriate insulative material.

In the device 10 of FIG. 6, the arcing rod 90 carries no pin-like member 92. The aperture 86 in the wall 84 mounts for sliding movement therein a release pin 140. The release pin 140 also passes through an aperture 142 formed in the end ferrule 36. The aperture 142 is coaxial with the aperture 86. Normally, the release pin 140 does not protrude beyond the end ferrule 36 (as shown in FIG. 6) but does protrude into the chamber 80 in the conductive tube 78. The release pin 140 may be biased to its normal position by a spring (not shown).

Upon operation of the device 10 of FIG. 6, the spring 100 moves the arcing rod 90 and the plate 88 toward the end ferrule 36. Ultimately, the plate 88 contacts the protruding end of the release pin 140 within the chamber 80. The spring 100 is sufficiently strong to move the release pin 140 outwardly so that it protrudes beyond the end ferrule 36. Such movement of the release pin 140 may be utilized to trigger an appropriate latch release mechanism (not shown) in the jaw-engaging facility 60, the jaw contact 62 or both, as is well known. Operation of the latch release mechanism permits the device 10 to pivot in its hinge facility 68 about the hinge contact 70 to the dropout position shown in dotted lines in FIG. 3.

Figure 7:
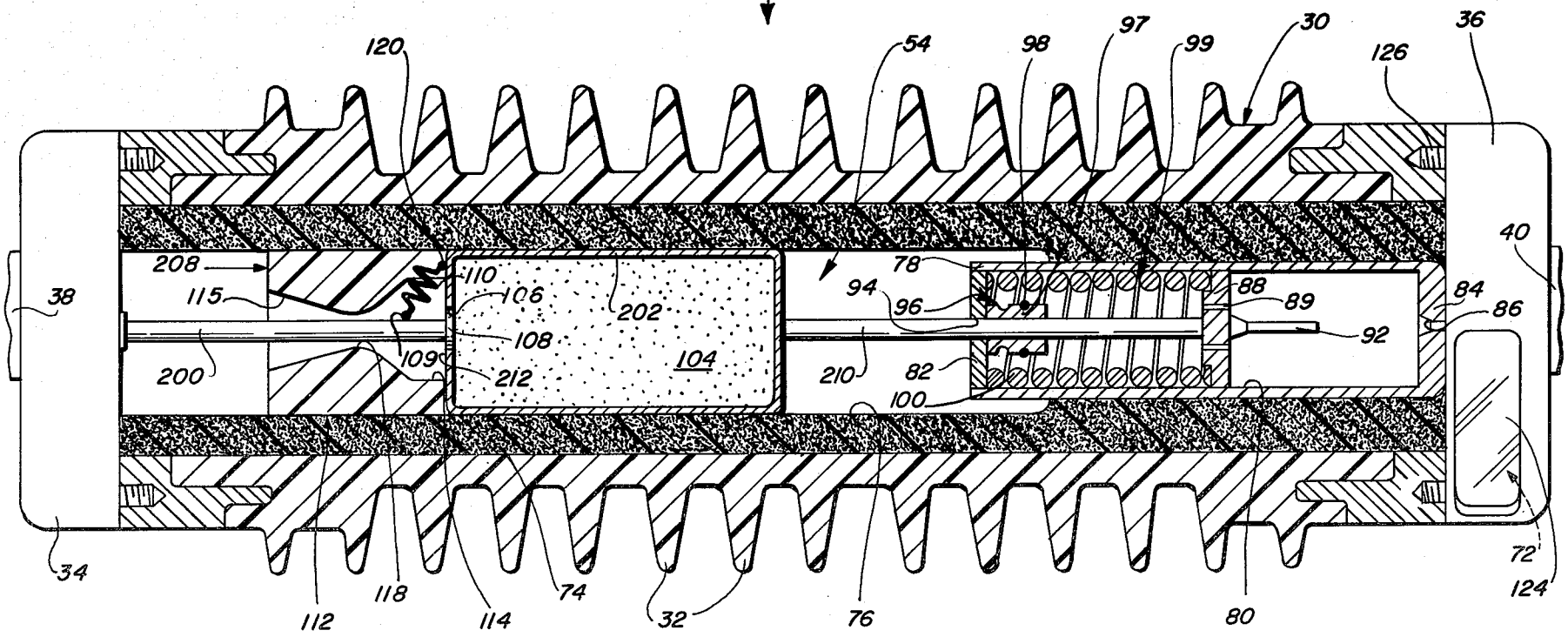
FIG. 7 depicts a third embodiment of the device of FIGS. 1–3.

Interrupting Unit 54—FIG. 7—Third Embodiment

The device 10 of FIG. 7 functions similarly to those of FIGS. 4, 4*a*, 5, 5*a*, and 6, and may be used in any of the configurations of FIGS. 1–3. Where the elements of the device 10 in FIG. 7 are the same as, or similar to, corresponding elements in earlier Figures, the same or similar reference numerals are used.

The device 10 is a single-gap device along the lines of FIGS. 4 and 4*a* wherein, however, an arcing rod 200 is stationary and a reservoir 202 of the fluid 104 moves.

The arcing rod 200 is mechanically and electrically connected to the ferrule 34, but is otherwise similar to the arcing rods 90 and 90'. The arcing rod 200 is mechanically and electrically attached to a diaphragm 108, which normally closes a port 106 of the reservoir 202. The reservoir 202 is mounted for axial movement within the insulative cylinder 74 and carries therewith a movable nozzle 208, otherwise similar to the nozzles 112 and 112'. A fusible element 110 is connected between the arcing rod 200 and the reservoir 202 at points 109 and 120.

Spaced from the movable reservoir 202 is a conductive tube 78, a wall 84 thereof contacting the ferrule 36. A connecting rod 210 is attached between the reservoir 202 and a plate 88. A spring 100 biases the plate 88 and the reservoir 202 away from the arcing rod 200, but is normally prevented from moving the reservoir 202 by the diaphragm 108. A tulip contact 96 ensures electrical continuity between the tube 78 and the reservoir 202 through the rod 210.

A first or shunt current path 200, 110 is connected between the ferrules 34 and 36 as follows: the ferrule 34, the arcing rod 200, the point 109, the fusible element 110, the point 120, the reservoir 202, the rod 210, the tulip contact 96, the wall 82, the tube 78, the wall 84, and the ferrule 36. As before, the shunt path effects the flow of only a small current in the second current path 200, 108.

When the diaphragm 108 melts after the fusible element 110 has melted, the port 106 is opened to the flow of the fluid 104. Simultaneously, the spring 100 moves the reservoir 202 away from the arcing rod 200 to elongate the arc established between the arcing rod 200 and a movable contact 212, which preferably comprises a portion of the reservoir 202 adjacent the port 106, similar to the stationary contact 122. As with the stationary contact 122, the movable contact 212 may comprise separate structure (not shown) on or carried by the reservoir 202. Arc elongation and the fluid 104 extinguish the arc.

A two-gap device (not shown) along the lines of FIG. 7 may be achieved by connecting the left end of the arcing rod 200 to a seal closing a port of a second movable reservoir. The second reservoir would be springbiased as is the reservoir 202, but would include near its port a tulip contact, similar to 136, and an insulated path, similar to the elements 130 and 132, therearound. The insulated path would be connected between the connecting rod for the second reservoir and the tulip contact.

Conclusion

The above embodiments of the circuit interrupting device 10 according to the present invention are illustrative only and are intended to instruct one skilled in the art about various aspects of the present invention. Various changes or modifications of the described structure, some of which are outlined below, can be made without departing from the scope of the appended claims.

As noted above, a preferred dielectric fluid 104 is $SF_6$. Clearly, other appropriate dielectric fluids (gases or liquids) may be used.

In the prior art, the term "arcing rod" often means a movable, elongated contact. The arcing rods 90 and 90' meet that description. The stationary arcing rod 200 does not. Accordingly, the term "arcing rod" herein simply refers to one of the two relatively movable contacts, movable or stationary, between which an arc is established during current interruptions and between which a gap is formed during relative movement. Along the lines of this broadened definition, the arcing rods herein may take the form of smaller contact members (or a shortened arcing rod), which, as alternatives to the arcing rods 90 and 90', may be connected directly to one end of a spring, the other end of which is connected to one of the ferrules 34 or 36. Electrical continuity between the contact member and the ferrule may be insured by a flexible conductor connected therebetween and within the spring, as is well known. Movement of the contact member is effected by collapse of the tension spring. This arrangement permits the formation in a device 10 of a given length of a longer gap between the contacts than is achievable with the elongated arcing rods 90 and 90'. Accordingly, the term "arcing rod" herein encompasses also such smaller contact members.

In preferred embodiments, the arcing rod and the diaphragm are mechanically joined as part of the second current path. The first current path including the fusible element shunts current away from the diaphragm. Preferably, the majority of the current through the device flows through the first path, although there may be equal, or nearly equal, amounts of current flowing in the two paths. As noted earlier, the important factors are that the fusible element, not the diaphragm, determines the TCC of the device 10, and that the diaphragm melts after the fusible element melts. The terms "shunt" or "first path" and the gerund "shunting" also contemplate a relationship between the arcing rod and the diaphragm wherein they may not be directly mechanically connected, but in any event are not normally electrically continuous. Specifically, a small insulated gap may normally exist between the arcing rod and the diaphragm; the fusible element and the first path normally carry all current through the device. When the element melts, an arc is established in the small insulated gap between the arcing rod and the diaphragm so that the diaphragm now carries all the current through the device and ultimately melts. Thus, the words "shunt", "first path" and "shunting" also refer to a device 10 in which normally the fusible element carries all the current through the device while the diaphragm normally carries none.

It is also within the scope of the present invention that the various diaphragms 108 and 108' need not necessarily directly restrain relative movement of the contacts 90, 90' and 200 and 122, 122' and 212. The diaphragms 108 and 108' may be relied on primarily to close the port 106, while one or more separate strain wires (not shown) tied between the arcing rod 90, 90' and 200 and the reservoirs 102, 102' and 202 may be the primary restraint against relative contact movement or may aid the diaphragm in that regard.

The diaphragms 108 and 108' may be made entirely of very thin sections of materials such as stainless steel or may be thicker sections with a central portion or portions of reduced cross-section which will easily melt when current normally shunted away therefrom by the fusible element 110 flows therethrough. It is not necessary for the entire diaphragms 108 or 108' to melt. As long as a well-defined porjtion thereof predictably and reliably melts to release the arcing rod 90, 90' or 200 and to permit sufficient fluid 104 to flow out of the holes 111 and 111' and the ports 106 and 106', the requirements of the preferred embodiments of the present invention are satisfied. In two-gap device 10, the diaphragms 108 and 108' may be made sufficiently similar, so that the current flowing therein following melting of the fusible element 110 is sufficient to cause both diaphragms 108 and 108' to melt substantially simultaneously thereafter, thereby releasing both arcing rods 90 and 90' at substantially the same time.

Movement of the arcing rods 90 and 90' in FIGS. 4 and 5 is primarily due to the action of the springs 100 and 100'. If the wall 82 is spoke-like or vented, the increasing pressure due to the fluid 104 flowing from the port 106 applies a force to the plate 88 in aid of the spring force. In the event this approach is used, the passages 89 in the plate 88 may be eliminated and a one-way valve (not shown) or the like may be provided in the end ferrule 36 to relieve pressure build-up in the chamber 80, The sonic or near sonic flow rate of the fluid 104 past the throat 118 is preferably maintained for a time corresponding to at least two or three of the alternating current zeros, at the normal frequency of the circuit 12, 14 in which the device 10 is used. This characteristic may be ensured by prepressurizing sufficiently large reservoirs 102, 102' and 202 with the fluid 104 to a preselected pressure above atmospheric. Fluid flow following operation of the device 10 continues until the pressure in the chambers 114 and 115 and in the interior of the housing 30 equals the pressure in the reservoirs 102, 102' and 202. Preferably, the end ferrules 34 and 36 are such as to seal the housing 30 against the escape of any of this fluid 104. Such sealing of the housing 30 ensures that following operation of the device 10, there remains sufficient internal dielectric strength to hold the voltage of the circuit 12, 14 over a reasonable period of time until the device 10 is replaced (FIG. 1), is refitted with new elements (FIG. 2), or drops out (FIG. 3). Appropriate seals, such as O-rings or the like, may be used to ensure sealing of the ferrules 34 and 36 to the housing 30.

A preferred material for the housing 30 is a cycloaliphatic epoxy resin material which has good dielectric, mechanical, and structural properties. The material of the insulative tube 74 is preferably a low dielectric permittivity, high dielectric strength material. The use of such material for the insulative tube 74 grades and distributes the electrical field stress appearing across the open gap or gaps following operation of the device 10. Such grading, in turn, leads to a more uniform electrical potential gradient in the air surrounding the device 10. In the event that the low dielectric permittivity, high dielectric strength material of the insulative tube 74 is a foam or the like which does not have much structural integrity, the housing 30 must have sufficient structural integrity as to ensure proper support of the various elements within the device 10.

Unlike some of the above-described prior art devices, the flow path for the fluid 104 in the present invention is very direct, and non-tortuous. Moreover, unlike prior art devices, the present device 10 does not have its diaphragms 108 and 108' in electrical series with the fusible element 110. That is, current does not normally flow through the diaphragms 108 and 108'. Moreover, many prior art devices using a stopper to normally prevent the flow of an arc-extinguishing fluid rely on the burning, by an arc, of a hole in the stopper to release the fluid. This should be contrasted with the present invention in which the diaphragms 108 and 108' melt as a result of the discontinuance of a normal shunt path therearound which includes the fusible element 110. By the use of the fusible element 110 of the present invention to normally shunt current away from the diaphragms 108 and 108', the diaphragms 108 and 108' may be the same or substantially the same in all ampere ratings of devices 10 which utilize the principles of the present invention. Moreover, such diaphragms 108 and 108' need not be current rated. This is because the diaphragms 108 and 108' normally carries little or no current and accordingly can be made to melt upon the flow therethrough of any substantial current. Moreover, except for their length and the current rating of the fusible element 110, devices 10 in accordance with the present invention may be otherwise quite similar or identical at all ampere and voltage ratings.

What is claimed is:

1. An improved circuit interrupting device of the type in which a first contact and a second contact move relatively apart following the melting of a fusible element, and in which a flow of dielectric fluid is directed at an elongating arc established between the parting contacts; wherein the improvement comprises:

diaphragm means for normally preventing the flow of the fluid; and means, including the fusible element, for normally shunting away from the diaphragm means current flowing through the device, all of which current flows in and melts the diaphragm means after the fusible element melts.

2. A device according to claim 1, wherein the diaphragm means normally prevents relative movement of the contacts.

3. A device according to claim 2, which further comprises a reservoir for confining the fluid under pressure, the reservoir having a port out of which the fluid flows, the diaphragm means normally closing the port.

4. A device according to claim 3, wherein the reservoir mounts the second contact, and the diaphragm means is normally mechanically connected to the first contact to prevent relative movement of the contacts.

5. A device according to claim 1, wherein the shunting means shunts away from the diaphragm means sufficient current to prevent the melting of the diaphragm means until the fusible element melts.

6. A device according to claim 5, wherein the time-current characteristic of the device is substantially determined only by the time-current characteristic of the fusible element.

7. A device according to claim 1, wherein the shunting means shunts away from the diaphragm means the majority of the current flowing through the device.

8. A device according to claim 1, which further comprises:

a reservoir for confining the fluid under pressure, the reservoir having a port out of which the fluid flows, the diaphragm means normally closing the port.

9. A circuit interrupting device according to claim 8, wherein the reservoir mounts the second contact, and the diaphragm means is normally mechanically and electrically connected to the first contact to prevent relative movement of the contacts.

10. A device according to claim 9, wherein the shunting means comprises first means for electrically connecting one end of the fusible element to the first contact.

11. A device according to claim 10, which further comprises:

stored energy means for biasing the contacts apart.

12. A device according to claim 11, of the type including opposed circuit-connectable terminals, wherein the reservoir and the diaphragm means are electrically conductive; and which further comprises second means for electrically connecting the second contact to the reservoir;

third means for eletrically connecting the reservoir to one terminal;

fourth means for electrically connecting the first contact to the other terminal; and fifth means for electrically connecting the other end of the fusible element to the one terminal;

a majority of the current flowing through the device between the terminals normally following a first path including the first contact and the fusible element; a minority of the current flowing through the device between the terminals normally following a second path including the first contact, the diaphragm means and the reservoir; all of the current flowing through the device between the terminals following the second path after the fusible element melts.

13. A device according to claim 12, wherein the fifth means includes an electrical connection between the other end of the fusible element and the reservoir, the connection being remote from the diaphragm means.

14. A device according to claim 12, wherein the fifth means includes an electrical connection between the other end of the fusible element and the one terminal, the electrical connection being electrically insulated from the reservoir.

15. A device according to claim 1, wherein the first contact is movable and the second contact is stationary.

16. A device according to claim 15, which further comprises a reservoir for confining the fluid under pressure, the reservoir having a port out of which the fluid flows, the diaphragm means normally closing the port.

17. A device according to claim 16, wherein the reservoir is stationary, the second contact is near the port, and the first contact is movable away from the reservoir and the second contact.

18. A device according to claim 17, which further comprises stored energy means for moving the first contact after the diaphragm means melts.

19. A device according to claim 17, wherein the first contact is normally mechanically connected to the diaphragm means to prevent movement of the first contact.

20. A device according to claim 16, wherein the reservoir is movable, the first contact is near the port, and the first contact and the reservoir are jointly movable away from the second contact.

21. A device according to claim 20, which further comprises stored energy means for moving the first contact and the reservoir after the diaphragm melts.

22. A device according to claim 20, wherein the second contact is normally mechanically connected to the diaphragm means to prevent movement of the first contact.

23. An improved circuit interrupting device of the type in which a movable contact moves away from a stationary contact following melting of a fusible element, and in which a flow of dielectric fluid is directed at an elongating arc established between the contacts; wherein the improvement comprises:

fusible diaphragm means for normally preventing the flow of the fluid and for normally preventing movement of the movable contact; and means, including the fusible element, for normally shunting away from the diaphragm means the current flowing through the device until the fusible element melts, at which time all of the current flowing through the device flows in and melts the diaphragm means.

24. A device according to claim 23, the device being further of the type connectable to a circuit by opposed terminals, a first terminal being continuously electrically connected to the movable contact, a second terminal being continuously electrically connected to the stationary contact; the device also having a stored energy source biasing the movable contact for movement, and a reservoir out of a port of which the fluid flows; wherein the improvement further comprises:

the diaphragm means normally closing the port and being normally attached to the movable contact;

the stationary contact being adjacent the port; and the shunting means comprising first means for electrically connecting one end of the fusible element to the movable contact.

25. A device according to claim 24, wherein the improvement further comprises the reservoir being electrically conductive;

the stationary contact being a portion of the reservoir adjacent the port; and means for electrically connecting the reservoir to the second terminal to continuously electrically connect the stationary contact to the second terminal.

26. A device according to claim 25, wherein the shunting means further comprises second means for electrically connecting the other end of the fusible element to the reservoir remotely from the port.

27. A device according to claim 25 wherein the shunting means further comprises a current-carrying shunt path electrically insulated from the reservoir; and second means for connecting the other end of the fusible element to the shunt path.

28. A device according to claim 26 which further comprises nozzle means for directing gas from the port at the arc at sonic or near sonic velocity.

29. A device according to claim 26, which further comprises an outer insulative housing enclosing the device;

the first terminal including a first end ferrule sealing one end of the housing; and the second terminal including a second end ferrule sealing the other end of the housing.

30. A device according to claim 29, wherein the stored energy source comprises a stationary reaction member;

a movable reaction member mounted to the movable contact; and a spring acting between the reaction members.

31. A device according to claim 30, which further comprises a conductive tube, a first end of which is electrically connected to the first end ferrule, a second end of which is the stationary reaction member, the movable reaction member and the spring being within the tube; and sliding contact means electrically connected to the tube for slidably contacting the movable contact in all positions thereof.

32. A device according to claim 31 which further comprises nozzle means for directing fluid from the port at the arc, the nozzle means being made of a temperature-resistant dielectric material and comprising a first chamber surrounding the port;

a second chamber remote from the port; and a constricted throat interconnecting the chambers, the movable contact being movable through the chambers.

33. A device according to claim 31, which further comprises a continuous aperture through the first end of the conductive tube and partially through the first end ferrule;

a pin carried on the movable contact, a predetermined amount of movement of the movable contact effecting passage of the pin through the aperture;

a window in the first end ferrule; and means for providing through the window a visual indication of movable contact movement in response to passage of the pin through the aperture.

34. A device according to claim 29, which further comprises an inner insulative housing within the outer housing, the inner housing maintaining in fixed relative positions the gas reservoir, the means for connecting the reservoir to the second terminal, the first and second electrical connecting means, and the means for connecting the movable contact to the first terminal.

35. A device according to claim 34 wherein the inner housing is affixed to the outer housing.

36. A device according to claim 34 wherein the inner housing is selectively removable from the outer housing and is held therewithin by one of the end ferrules which is selectively mountable on and removable from the outer housing.

37. A device according to claim 27, wherein two arcs are formed in a pair of series gaps, wherein the improvement further comprises:

a second port in the reservoir;

the means for connecting the reservoir to the second terminal comprises a second movable contact; and second fusible diaphragm means for normally closing the second port and for normally preventing movement of the second movable contact;

a second stored energy source for moving the second movable contact;

a second stationary contact comprising a portion of the reservoir adjacent the second port; and means for normally connecting the second movable contact to the shunt path so that the majority of the current flowing through the device is normally shunted away from both diaphragms and from the reservoir.

38. A device according to claim 37, which further comprises nozzle means for directing fluid from both ports at the arcs at sonic or near sonic velocity.

39. A device according to claim 37, which further comprises an outer insulative housing surrounding the device;

the first terminal including a first end ferrule sealing one end of the housing; and the second terminal including a second end ferrule sealing the other end of the housing.

40. A device according to claim 39, wherein the stored energy sources each comprise a reaction member pair, having a stationary reaction member, and a movable reaction member mounted to each movable contact; and a spring acting between each reaction member pair.

41. A device according to claim 40, which further comprises means for continuously connecting the first movable contact to the first terminal, which comprises a first conductive tube, a first end of which is electrically connected to the first end ferrule, a second end of which is one of the stationary reaction members, one of the movable reaction members and one of the springs being within the first tube, and first sliding contact means electrically connected to the first tube for slidably contacting the first movable contact in all positions thereof; and wherein the means for connecting the reservoir to the second terminal further comprises a second conductive tube, a first end of which is electrically connected to the second end ferrule, a second end of which is the other stationary reaction member, the other movable reaction member and the other spring being within the second tube; and second sliding contact means electrically connected to the second tube for slidably contacting the second movable contact in all positions thereof.

42. A device according to claim 41, which further comprises nozzle means for directing fluid from both ports at the arcs, the nozzle means being made of a temperature-resistant dielectric material and respectively comprising a first chamber surrounding each port;

a second chamber remote from each port; and a constricted throat interconnecting each first and second chamber, the movable contacts being movable through the chambers of their respective nozzle means.

43. A device according to claim 41, which further comprises a continuous aperture through the first end of one of the conductive tubes and partially through one of the end ferrules;

a pin carried by one of the movable contacts, a predetermined amount of movement of the one movable contact effecting passage of the pin through the aperture;

a window in the one end ferrule; and means for providing through the window a visual indication of movement of the one movable contact in response to passage of the pin through the aperture.

44. An improved device according to claim 39, which further comprises an inner insulative housing mounted within the outer housing, the inner housing maintaining in fixed relative positions the gas reservoir, the means for connecting the reservoir to the second terminal, the shunt path, the first and second electrical connecting means, and the means for connecting the first movable contact to the first terminal.

45. A device according to claim 44 wherein the inner housing is affixed to the outer housing.

46. A device according to claim 44 wherein the inner housing is selectively removable from the outer housing and is held therewithin by one of the end ferrules which is selectively mountable on and removable from the outer housing.

47. A device according to claim 31 which further comprises a continuous passageway formed through the first end of the conductive tube and the first end ferrule; and a pin mounted in the passageway for sliding movement, the pin normally being partially located within the conductive tube and not extending beyond the first end ferrule, movement of the movable reaction member thereagainst sliding the pin in the passageway until it protrudes beyond the first end ferrule.

48. The device of claim 41, which further comprises a continuous passageway formed in the first end of one of the conductive tubes and in one of the end ferrules, a pin mounted in the passageway for sliding movement, the pin normally being partially located within the one conductive tube and not extending beyond the one end ferrule, movement of one of the movable reaction members thereagainst sliding the pin in the passageway until it protrudes beyond the one end ferrule.

49. An improved circuit interrupting device of the type wherein, after a fusible element ceases to be intact in response to a current of a predetermined magnitude through the device, a movable contact is moved away from a stationary contact; and wherein a flow of dielectric fluid is directed at an elongating arc established between the contacts; the improvement comprising:

(a) fusible diaphragm means for normally preventing the flow of the fluid; and (b) shunting means for (i) normally directing through the fusible element, and normally shunting away from the diaphragm means, a majority of the current flowing through the device, and (ii) after the fusible element ceases to be intact, directing through the diaphragm means all of the current flowing through the device.

50. A device according to claim 49, wherein the diaphragm means also normally prevents movement of the movable contact, and the shunting means shunts away from the diaphragm means between all and fifty percent of the current flowing through the device.

51. A device according to claim 49, which further comprises means for biasing the movable contact for movement away from the stationary contact; and means for mechanically attaching the movable contact to the intact diaphragm means, the intact diaphragm means being sufficiently strong to prevent movement of the movable contact by the biasing means.

52. A device according to claim 49, which further comprises a reservoir which contains a quantity of the fluid under pressure; and a port in the reservoir from which the fluid flows, the port being normally closed by the intact diaphragm means.

53. A device according to claim 49, wherein the stationary contact comprises a portion of the reservoir adjacent the port.

54. A device according to claim 49, which further comprises a first insulative housing for the device; and a second insulative housing within the first housing, the second housing mounting and holding in normal fixed relative positions the fusible element, the diaphragm means and the shunting means, the contact being within the second housing.

55. A decive according to claim 54, wherein the second housing is selectively insertable in and removable from the first housing.

56. An improved circuit interrupting device of the type wherein, after a fusible element ceases to be intact in response to an overcurrent through the device, a movable contact is moved away from a stationary contact; and wherein a flow of dielectric fluid is directed at an elongating arc established between the contacts; the improvement comprising:

(a) fusible diaphragm means for normally, when intact,
(i) preventing the flow of the gas, and
(ii) preventing movement of the movable contact, the diaphragm means being of a type which ceases to be intact in response to the flow therethrough of current in excess of a predetermined magnitude; and
(b) shunting means for
(i) normally directing through the fusible element, and normally shunting away from the diaphragm means, a majority of the current flowing through the device so that a minority of the current flowing through the device normally flows through the diaphragm means; the minority of the current having a magnitude no greater than the predetermined magnitude; and
(ii) after the fusible element ceases to be intact, directing through the diaphragm means the entire current flowing through the device, the magnitude of the entire current through the device exceeding the predetermined magnitude.

57. A device according to claim 56, wherein
a first normal current path includes the movable contact and the fusible element in electrical series, and
a second normal current path includes the movable contact and the diaphragm means in electrical series, the electrical resistance of the second path being substantially higher than that of the first path.

58. A device according to claim 57, which further comprises
first and second circuit-connectable terminals;
first means for continuously electrically connecting the movable contact to the first terminal;
second means for electrically serially connecting the first normal current path to the second terminal; and
third means for electrically serially connecting the second normal current path to the second terminal in electrical parallel with the first normal current path.

59. A device according to claim 58, which further comprises
a reservoir normally containing a quantity of the fluid under pressure; and
a port in the reservoir from which the fluid flows, the port being normally closed by the intact diaphragm means.

60. A device according to claim 59, wherein
the reservoir is electrically conductive and is included in both normal current paths.

61. A device according to claim 60, wherein
one end of the fusible element is electrically connected to the movable contact and the other end of the fusible element is electrically connected to the reservoir remote from the diaphragm means.

62. A device according to claim 59, wherein
the reservoir is electrically conductive and is in electrical series with the second normal current path, and
the second means and the first current path are electrically insulated from the second means and the reservoir.

63. A device according to claim 62 wherein
one end of the fusible element is electrically connected to the movable contact and the other end of the fusible element is electrically connected to the second means.

64. An improved circuit interrupting device, comprising
a reservoir of pressurized dielectric fluid;
first and second ports in the reservoir from which the fluid flows;
first and second stationary contacts adjacent a respective port;
first and second movable contacts biased for movement away from a respective stationary contact to define respective gaps, each gap being so positioned as to receive fluid flowing from a respective port;
first and second fusible diaphragm means for normally, while intact,
(a) closing a respective port, and
(b) preventing movement of a respective movable contact; and shunting means, including a fusible element, for
(a) normally shunting current flowing through the device away from both diaphragm means, and
(b) after the fusible element ceases to be intact, directing through both diaphragm means all of the current flowing through the device so that both diaphragm means cease to be intact to open both ports and permit movement of both movable contacts, respective arcs being formed in the gaps.

65. A device according to claim 64, which further comprises
means for electrically interconnecting the stationary contacts.

66. A device according to claim 65 wherein
the reservoir is electrically conductive,
the stationary contacts are respective portions of the reservoir adjacent the respective ports, and
the interconnecting means includes the reservoir.

67. A device according to claim 66 wherein
the shunting means comprises
an electric conductor connected between one of the movable contacts and one end of the fusible element, and
means for connecting the other end of the fusible element to the other movable contact,
current flowing through the device normally being directed between the movable contacts via the shunting means until the fusible element ceases to be intact.

68. A device according to claim 67, which further comprises
means for normally electrically connecting each movable contact to a respective diaphragm means so that after the fusible element ceases to be intact, current flowing through the device is directed between the movable contacts via the diaphragm means and the reservoir.

69. An improved circuit interrupting device of the type in which a first contact and a second contact move relatively apart following the melting of a fusible element, and in which a flow of dielectric fluid is directed at an elongating arc established between the parting contacts; wherein the improvement comprises:
diaphragm means for normally preventing the flow of the fluid; and
means for shunting away from the diaphragm means current flowing through the device as long as the fusible element is unmelted, and for directing such current through the diaphragm means to melt the diaphragm means after the fusible element melts.

* * * * *